US011453969B1

(12) United States Patent
Ford

(10) Patent No.: US 11,453,969 B1
(45) Date of Patent: Sep. 27, 2022

(54) WASHING MACHINE APPLIANCE HAVING A REMOVABLE AGITATOR

(71) Applicant: Haier US Appliance Solutions, Inc., Wilmington, DE (US)

(72) Inventor: James Augustine Ford, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/204,299

(22) Filed: Mar. 17, 2021

(51) Int. Cl.
*D06F 37/40* (2006.01)
*D06F 37/24* (2006.01)
*D06F 23/04* (2006.01)

(52) U.S. Cl.
CPC ..... *D06F 37/40* (2013.01); *D06F 23/04* (2013.01); *D06F 37/24* (2013.01)

(58) Field of Classification Search
None
See application file for complete search history.

(56) References Cited

U.S. PATENT DOCUMENTS 3,648,486 A * 3/1972 Rosinski, Jr. ..... D06F 13/00 68/4
4,077,239 A * 3/1978 Platt ..... D06F 13/02 68/184
10,787,761 B2 9/2020 Czarnecki

FOREIGN PATENT DOCUMENTS

CN 2571803 Y 9/2003
CN 203530690 U 4/2014
WO WO-2013088426 A2 * 6/2013 ..... D06F 37/16

* cited by examiner

*Primary Examiner* — Cristi J Tate-Sims
(74) *Attorney, Agent, or Firm* — Dority & Manning, P.A.

(57) ABSTRACT

A washing machine appliance or agitation element may include an impeller base and an extended post. The impeller base may include an impeller platform and a mounting face. The mounting face may define a recessed cup. The extended post may be removably attached to the impeller base to rotate therewith. The extended post may define an interior cavity. The extended post may include a mating collar and a connector bar. The mating collar may have a mating face disposed in selective engagement with the mounting face at the recessed cup. The connector bar may include an attachment piston slidably received within the interior cavity radially inward from the mating collar to move between a locked position and an unlocked position. The attachment piston may be in selective engagement with an inner surface of the mating collar at the locked position.

18 Claims, 11 Drawing Sheets

WASHING MACHINE APPLIANCE HAVING A REMOVABLE AGITATOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element (or portions thereof) could be readily removed between discrete washing operations or wash cycles (e.g., by a user without the use of any tools).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, an impeller base, and an extended post. The impeller base may be rotatably mounted within the basket and defining a rotation axis. The impeller base may include an impeller platform extending radially outward from the rotation axis and a mounting face defined on the impeller platform coaxial to the rotation axis. The mounting face may define a recessed cup. The extended post may be removably attached to the impeller base to rotate therewith. The extended post may extend along the rotation axis between a bottom end proximal to the impeller base and a top end distal to the impeller base. The extended post may define an interior cavity from the bottom end to the top end. The extended post may include a mating collar and a connector bar. The mating collar may have a mating face disposed on the bottom end in selective engagement with the mounting face at the recessed cup. The connector bar may include an attachment piston movably received within the interior cavity radially inward from the mating collar. The attachment piston may be in selective engagement with the mating collar to radially motivate the mating face toward the mounting face within the recessed cup.

In another exemplary aspect of the present disclosure, an agitation element for a washing machine appliance is provided. The agitation element may include an impeller base and an extended post. The impeller base may rotatably define a rotation axis about which the impeller base may rotate. The impeller base may include an impeller platform and a mounting face. The impeller platform may extend radially outward from the rotation axis. The mounting face may be defined on the impeller platform coaxial to the rotation axis. The mounting face may define a recessed cup. The extended post may be removably attached to the impeller base to rotate therewith. The extended post may extend along the rotation axis between a bottom end proximal to the impeller base and a top end distal to the impeller base. The extended post may define an interior cavity from the bottom end to the top end. The extended post may include a mating collar and a connector bar. The mating collar may have a mating face disposed on the bottom end in selective engagement with the mounting face at the recessed cup. The connector bar may include an attachment piston slidably received within the interior cavity radially inward from the mating collar to move between a locked position and an unlocked position. The attachment piston may be in selective engagement with an inner surface of the mating collar at the locked position to radially motivate the mating face toward the mounting face within the recessed cup.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
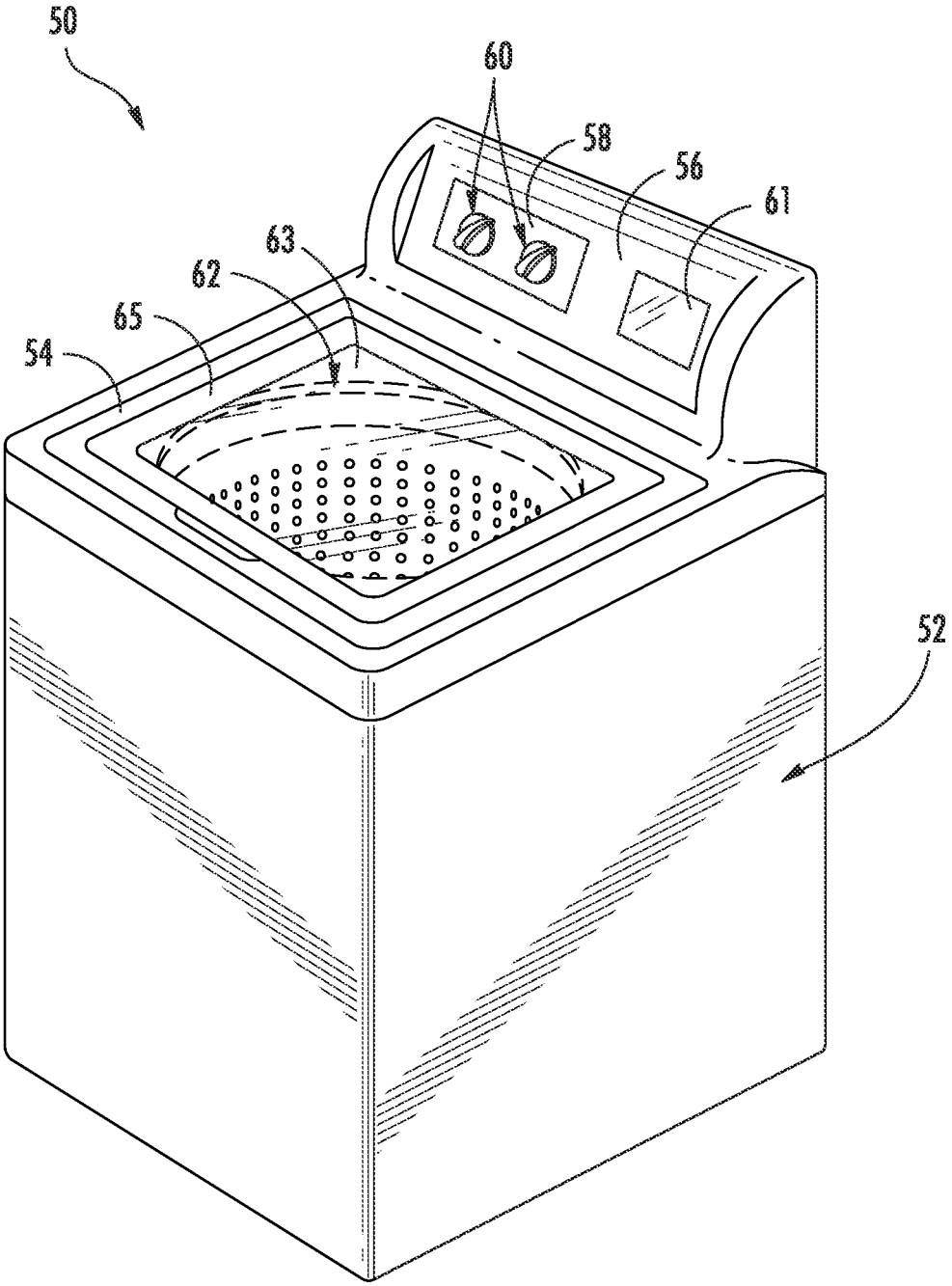
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
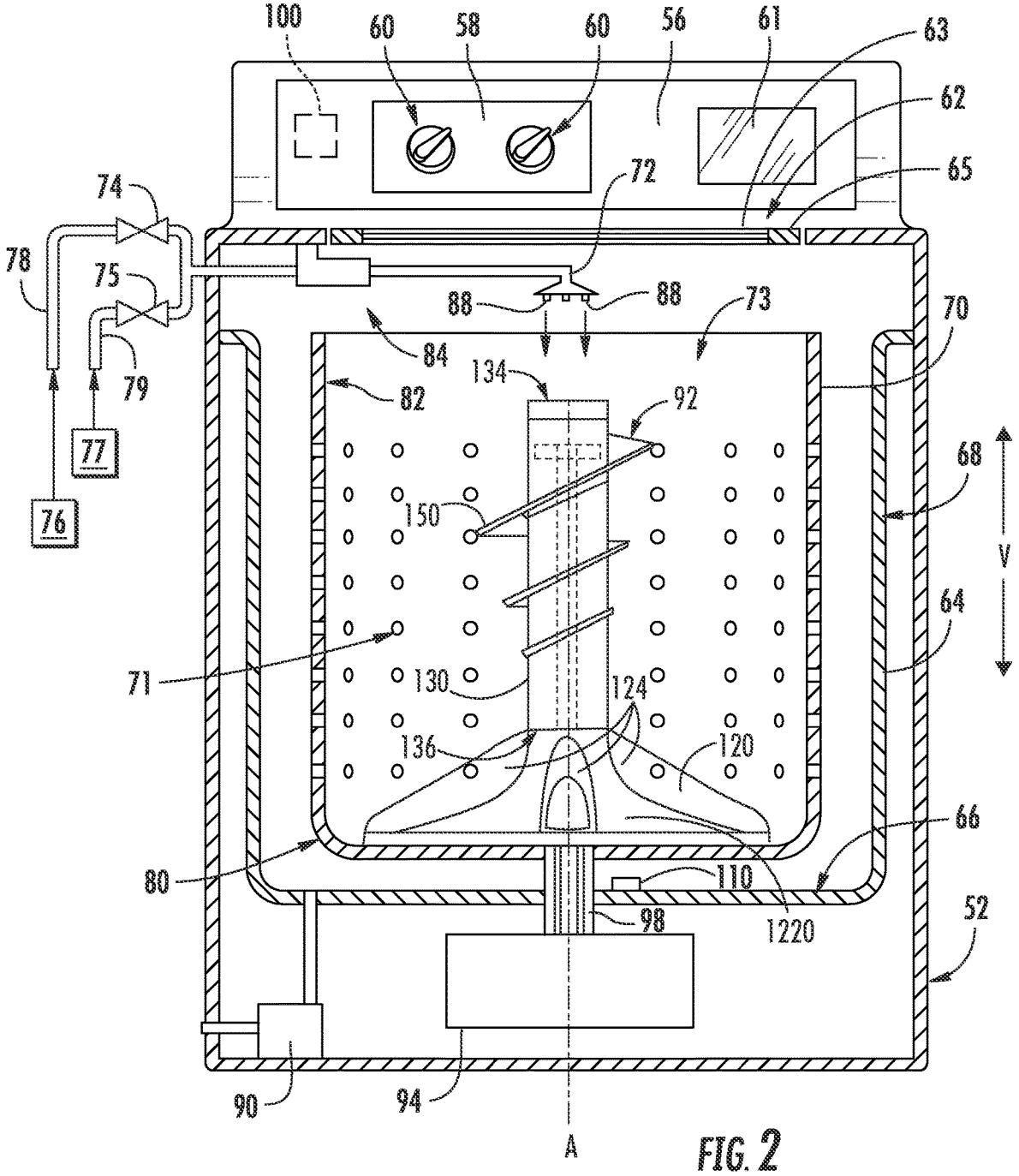
FIG. 2 provides a sectional elevation view of the exemplary washing machine appliance of FIG. 1.
Figure 3:
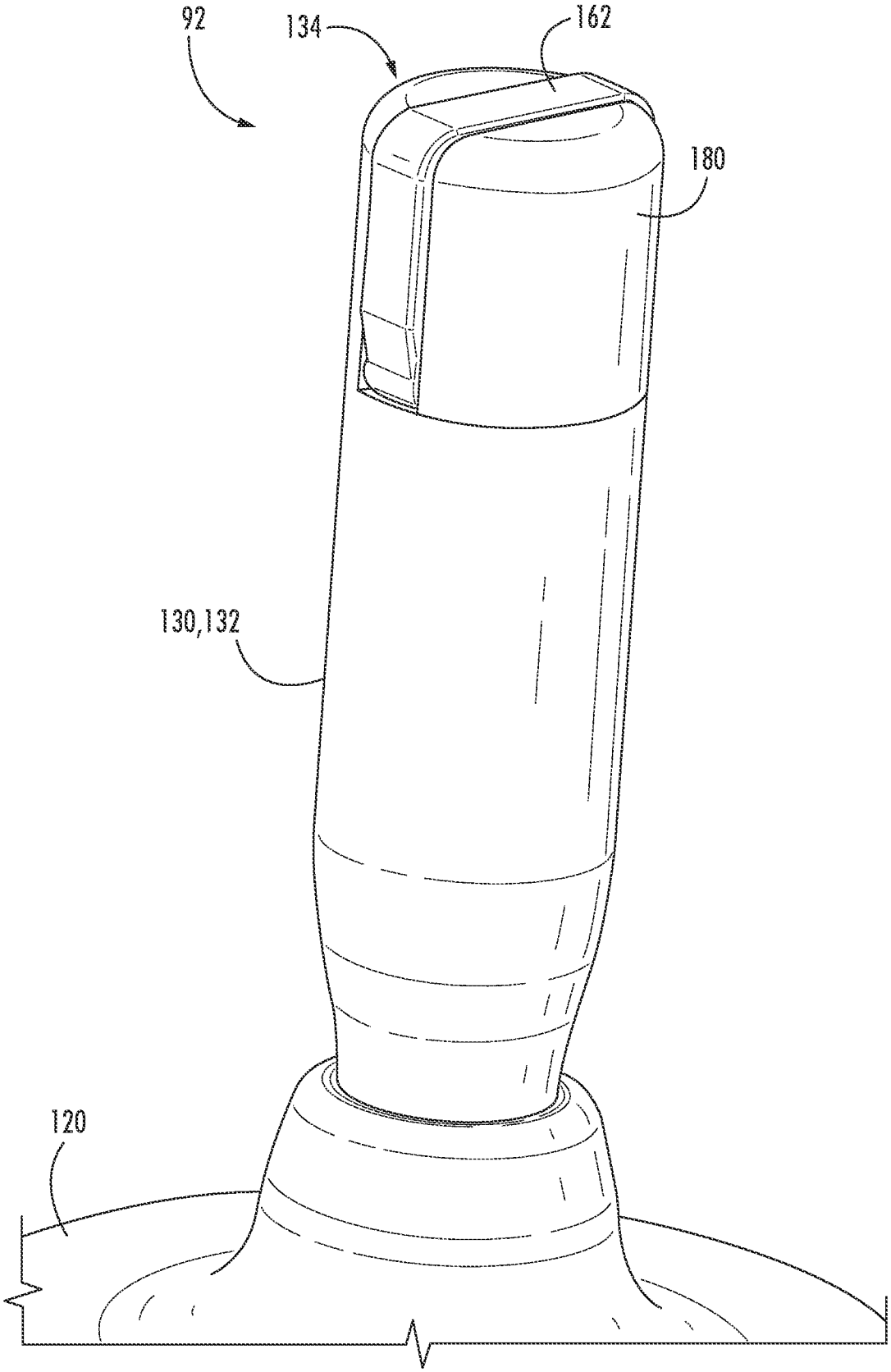
FIG. 3 provides a perspective view of an agitation element, in isolation, according to exemplary embodiments of the present disclosure.
Figure 4:
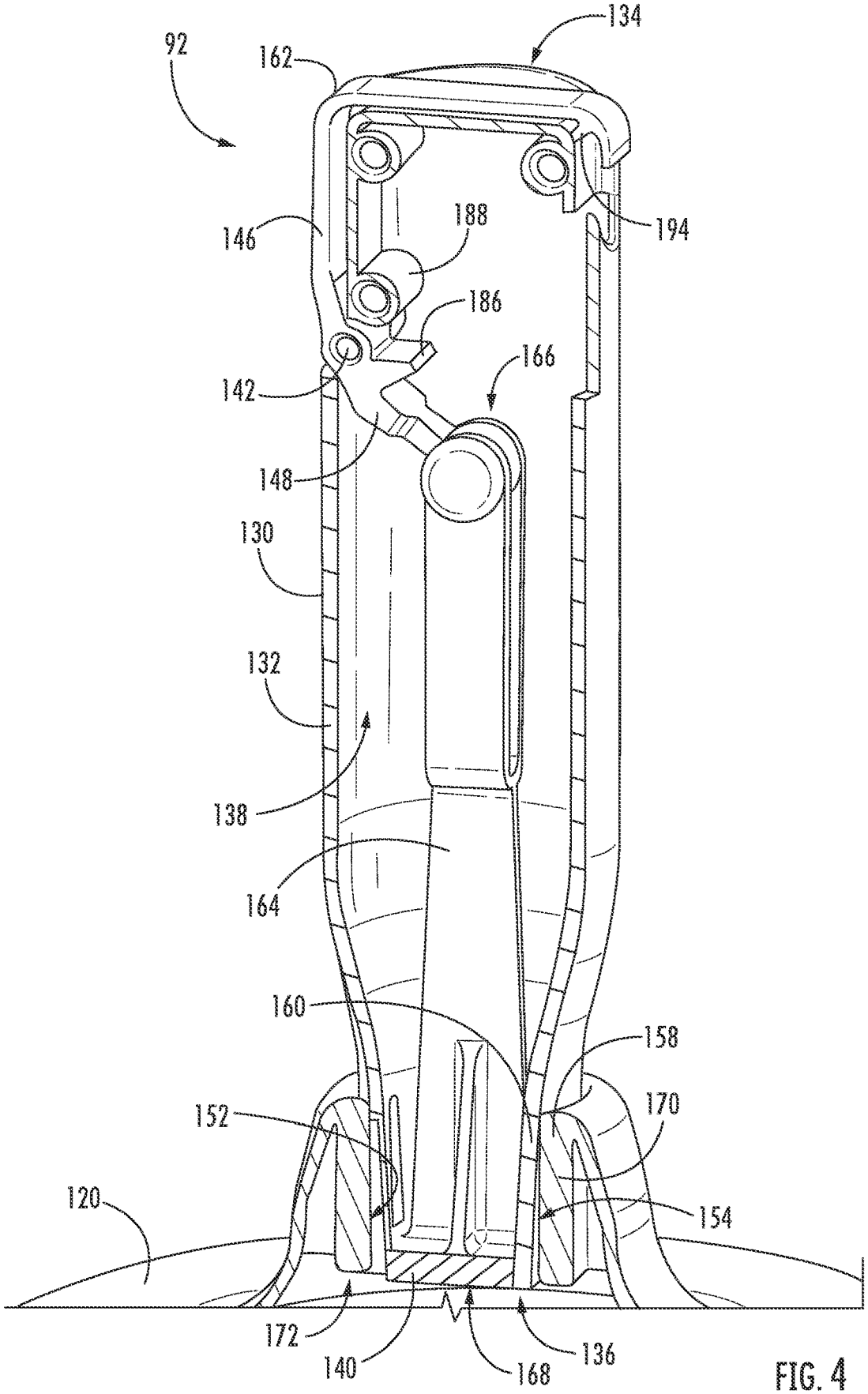
FIG. 4 provides a sectional perspective view of the exemplary agitation element of FIG. 3 in a locked position.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 13, various embodiments of agitation element 92 are illustrated. In some embodiments, agitation element 92 may include or be provided as a removable agitation element having an extended post 130 selectively attached to (and removable from) impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In some of the illustrated embodiments, auger fin 150 is formed as a helical coil wrapped about extended post 130. Nonetheless, any suitable shape or number of auger fins may be provided in alternative embodiments, as would be understood. Moreover, with respect to FIGS. 3 through 11, it is noted that the agitator element 92 is shown without an auger fin only for the purposes of clarity to show other portions of the agitator element 92 and should not be considered as limiting to embodiments with any particular auger fin shape.

As shown, impeller base 120 may provide a mounting face 152 that selectively connects to a mating face 154 of extended post 130. As shown, mounting face 152 may be disposed inward from the impeller fins 124. Thus, mounting face 152 may be located closer to rotation axis A than impeller fins 124. In some such embodiments, mounting face 152 is generally coaxial with rotation axis A (e.g., at a radial center of impeller base 120). In exemplary embodiments, mounting face 152 defines a recessed cup 158, which may be directed upward such that the recessed cup 158 is open to receive, for instance, a portion of extended post 130 (e.g., a mating collar 160) from above. As shown, recessed cup 158 may include a cup wall 170 that defines a lower lip 172 extending circumferentially about the rotation axis A to define an axially facing edge or surface within the impeller base 120.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. Specifically, mating face 154 may include or be defined by a mating collar 160 at bottom end 136. In some such embodiments, mating collar 160 extends (e.g., circumferentially) along and about the rotation axis A. Mating face 154 may, in turn, be directed radially outward away from rotation axis A. When assembled such that extended post 130 is attached to impeller base 120, mating collar 160 may be seated or received within recessed cup 158. Thus, mating face 154 may be in selective engagement with mounting face 152 at the recessed cup 158.

Generally, mating collar 160, or mating face 154 generally, is formed as a resilient or elastic member capable of resilient radial deformation, such as to slide axially to or from recessed cup 158. Optionally, mating collar 160 may be tapered inward (e.g., toward rotation axis A) such that the diameter of mating collar 160 generally decreases relative to proximity to bottom end 136. In other words, the diameter (e.g., outer diameter) of at least one portion of mating collar 160 near the bottom end 136 may be smaller than the diameter of mating collar 160 or base body 132 at another portion that is further from bottom end 136. In certain embodiments, mating collar 160 includes or is formed as a plurality of resilient fingers 174. Each of the resilient fingers 174 may be circumferentially spaced apart from each other. Thus, mating collar 160 may include a plurality of circumferentially spaced, resilient fingers 174. When assembled, each resilient finger 174 may form a cantilever having a free end proximal to (or at) bottom end 136 and an anchored or fixed end distal to (e.g., above) bottom end 136 and the free end. During attachment or removal of extended post 130, the free end of each resilient finger 174 may thus be permitted to radially deform (e.g., deflect inward) before returning to a default or original state.

In exemplary embodiments, mating collar 160 includes an enlarged radial rim 176 that extends radially outward from the rest of mating collar 160. Thus, the outer diameter defined at radial rim 176 may be larger than the portion of mating collar 160 from which it extends. As shown, radial rim 176 may be biased radially outward and define an outer diameter (e.g., at rest) that is greater than the inner diameter of lower lip 172. Moreover, radial rim 176 may be beveled. If a plurality of resilient fingers 174 are provided, radial rim 176 may be formed with some or all or all of resilient fingers 174. When assembled such that extended post 130 is attached to impeller base 120, radial rim 176 may be disposed below (e.g., directly beneath) lower lip 172. In turn, the radial rim 176 may be selectively disposed below lower lip 172 to hinder vertical movement of extended post 130 which may separate extended post 130 from impeller base 120. Nonetheless, under certain conditions, sufficient vertical force applied to extended post 130 may motivate extended post 130 radially inward (e.g., due to engagement with the rigid cup wall 170 of impeller base 120) as extended post 130 slides axially relative to extended post 130.

As shown, a connector bar 164 may be provided to selectively restrict movement of extended post 130 relative to impeller base 120. As shown, connector bar 164 may be disposed generally along the rotation axis A between a lower end 168 and an upper end 166. When extended post 130 is attached to impeller base 120, connector bar 164 may be received within an interior cavity 138 defined by base body 132. For instance, an attachment piston 140 may be movably (e.g., slidably or pivotally) received within interior cavity 138. During use, attachment piston 140 may be disposed radially inward from mating collar 160. Generally, attachment piston 140 may move axially between a locked position (e.g., FIGS. 4 and 10) and an unlocked position (e.g., FIG. 5), as will be described in greater detail below. When assembled such that extended post 130 is attached to impeller base 120 (e.g., in the locked position), lower end 168 may be disposed proximal to the impeller base 120 while upper end 166 is disposed above lower end 168, distal to impeller base 120. Moreover, attachment piston 140 attachment piston 140 may be in selective engagement with an inner surface of the mating collar 160 to radially motivate the mating face 154 toward the mounting face 152 within the recessed cup 158.

In certain embodiments, a post cap 180 is included with agitation element 92. As shown, post cap 180 may be placed on base body 132 (e.g., at top end 134) and cover interior cavity 138. Thus, when assembled, connector bar 164 and the rest of interior cavity 138 may generally be hidden from a user's view. In some embodiments, post cap 180 includes an upper cap wall (e.g., extending across rotation axis A above interior cavity 138) and a side cap wall extending downward from upper cap wall (e.g., to be held against or within base body 132). The side cap wall may be complementary to an interior surface of base body 132 or may otherwise include one or more mechanical fasteners (e.g., tabs, clips, shoulders, screws, etc.) to rotationally fix post cap 180 relative to base body 132, such as in friction fit engagement. Thus, during use, post cap 180 may be attached to extended post 130 in rotationally fixed engagement. When placed on base body 132, the side cap wall may thus be prevented from rotating relative to the rest of extended post 130.

Turning especially to FIGS. 4 through 6 and 10, attachment piston 140 may move (e.g., slide, pivot, or generally translate) axially between a locked position and an unlocked position, as noted above. In the locked position, the connector bar 164 holds the extended post 130 to the impeller base 120. Specifically, attachment piston 140 may be held within mating collar 160 (e.g., at a location within or directly above recessed cup 158) such that mating collar 160 is prevented from deflecting radially inward. As a result, the lower end 168 of the connector bar 164 is held at or above the bottom end 136 of the extended post 130. In turn, attachment piston 140 may motivate mating face 154 radially outward. For instance, an outer diameter or circumferential surface of attachment piston 140 may contact or motivate an inward facing surface of matting collar 160 (e.g., at the resilient fingers 174) radially outward. As shown (e.g., in solid lines at FIG. 6), the biasing of attachment piston 140 on mating collar 160 may lock radial rim 176 below lower lip 172.

In contrast to the locked position, the unlocked position may generally release the extended post 130 from the impeller post. Specifically, attachment piston 140 may be moved upward (e.g., relative to the locked position) above at least a portion of mating collar 160 and recessed cup 158. Thus, the unlocked position of attachment piston 140 is located above the locked position within the interior chamber 138. As a result, the lower end 168 of the connector bar 164 is held above the bottom end 136 of the extended post 130. In the unlocked position, mating collar 160 may be permitted to deflect radially inward. As shown (e.g., in phantom lines at FIG. 6), the radial rim 176 or free ends of the resilient fingers 174 may be permitted to radially deform (e.g., deflect inward in response to sufficient vertical force and engagement with a cup sidewall of recessed cup 158) as the extended post 130 is removed from or placed into recessed cup 158).

Advantageously, engagement between the mating collar 160 and recessed cup 158 may selectively and rotationally fix extended post 130 to impeller base 120. Moreover, the connection between the mounting face 152 and mating face 154 may notably resist side loads (e.g., generated by articles within wash chamber 73) and maintain the position of extended post 130 relative to impeller base 120.

Referring still to FIGS. 2 through 13, a bar latch 162 may be connected to connector bar 164 to selectively move attachment piston 140 between the locked and unlocked positions. Generally, bar latch 162 is attached to or in mechanical communication with connector bar 164. Movement of bar latch 162 between the locked and unlocked positions may, in turn, also move or direct connector bar 164 between the respective locked and unlocked positions.

Figure 10:
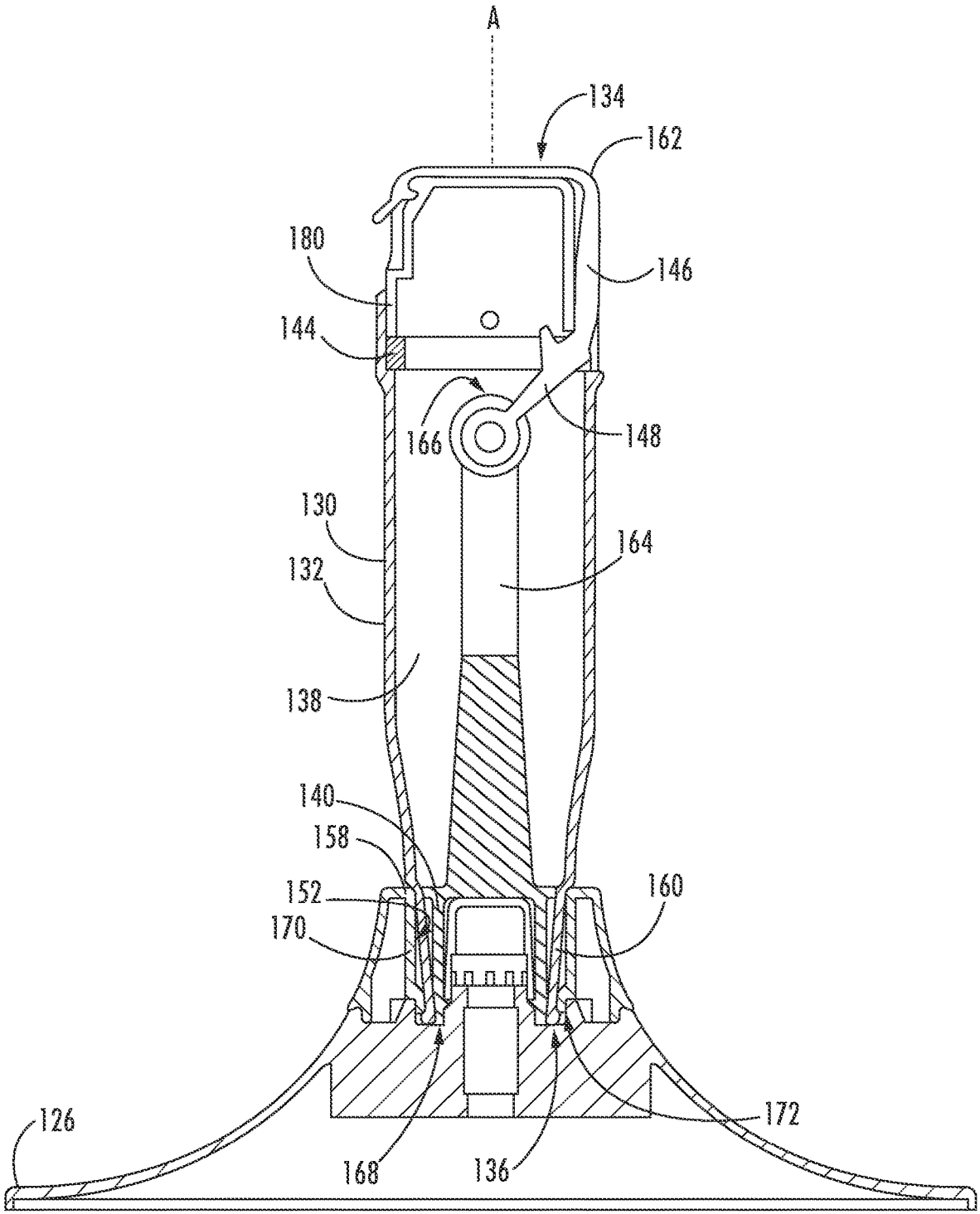
FIG. 10 provides a sectional elevation view of an agitation element, in isolation, according to exemplary embodiments of the present disclosure.
Figure 11:
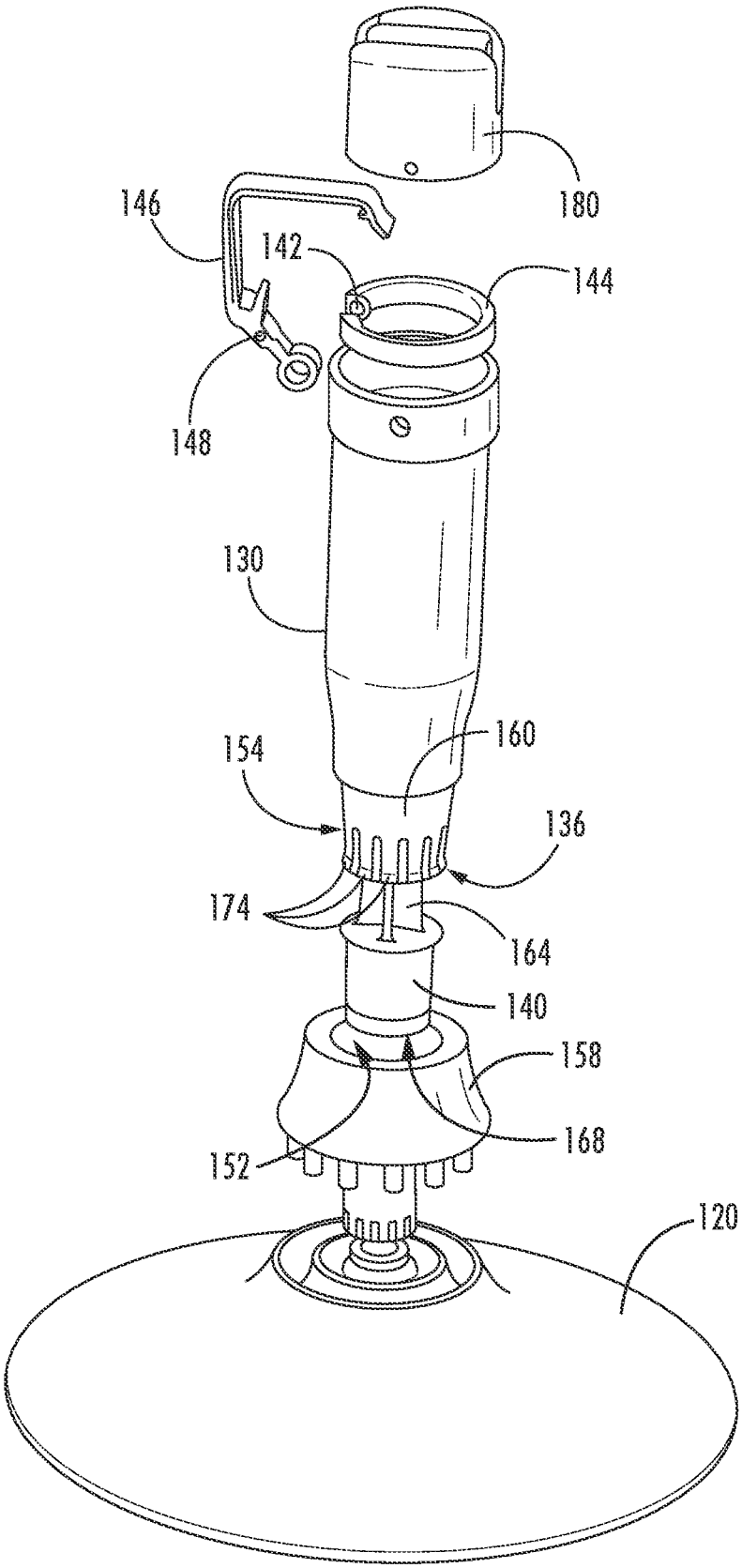
FIG. 11 provides an exploded perspective view of the exemplary agitation element of FIG. 3.
Figure 12:
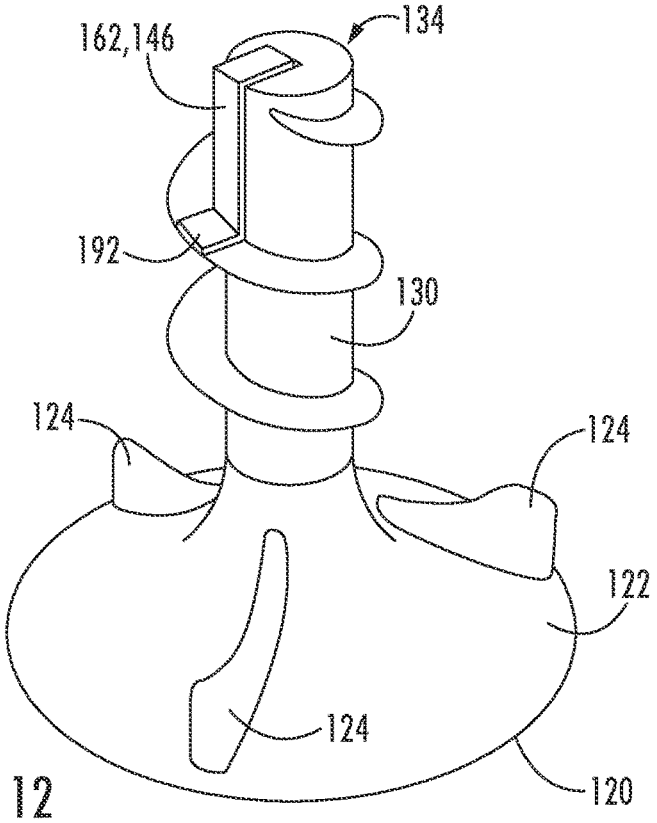
FIG. 12 provides a perspective view of an agitation element, in isolation and in the locked position, according to exemplary embodiments of the present disclosure.

In exemplary embodiments, bar latch 162 may be attached to base body 132 above the mating face 154. For instance, bar latch 162 may be pivotably attached to a fulcrum point or pin 142 (e.g., within the interior chamber 138). The fulcrum pin 142 may define a pivot axis P on base body 132 that is perpendicular to or spaced apart from the rotation axis A. As shown in FIGS. 4, 5, 7, and 9, fulcrum pin 142 may be formed on or extend directly from an interior surface of base body 132. Alternatively, as shown in FIGS. 10 and 11, fulcrum pin 142 may be formed on a discrete lever ring 144 that sits within interior chamber 138, such as on an internal ridge defined by an inner surface of base body 132, which may be joined to bar latch 162 outside of interior chamber 138 and advantageously ease assembly.

Figure 5:
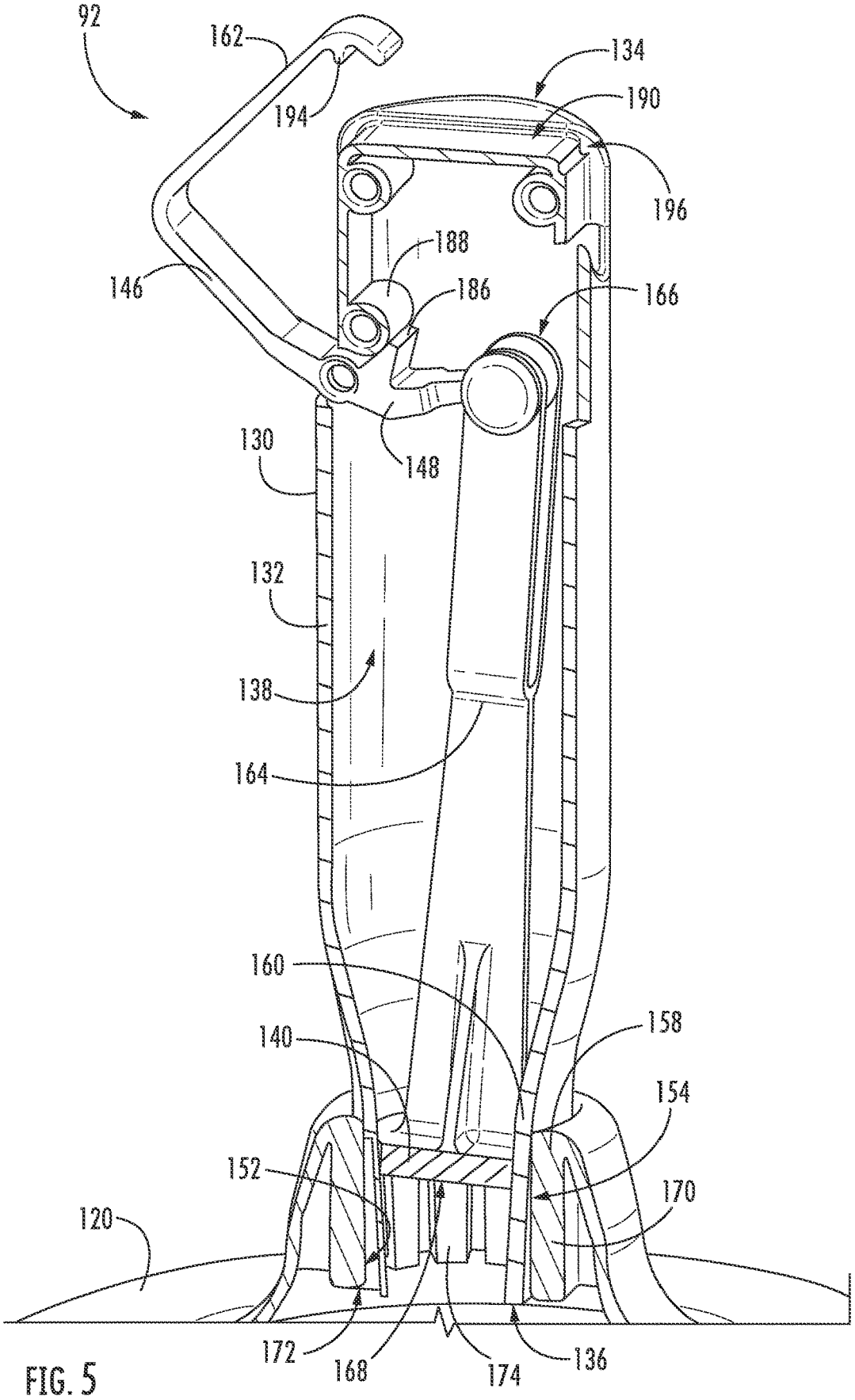
FIG. 5 provides a sectional perspective view of the exemplary agitation element of FIG. 3 in an unlocked position.
Figure 6:
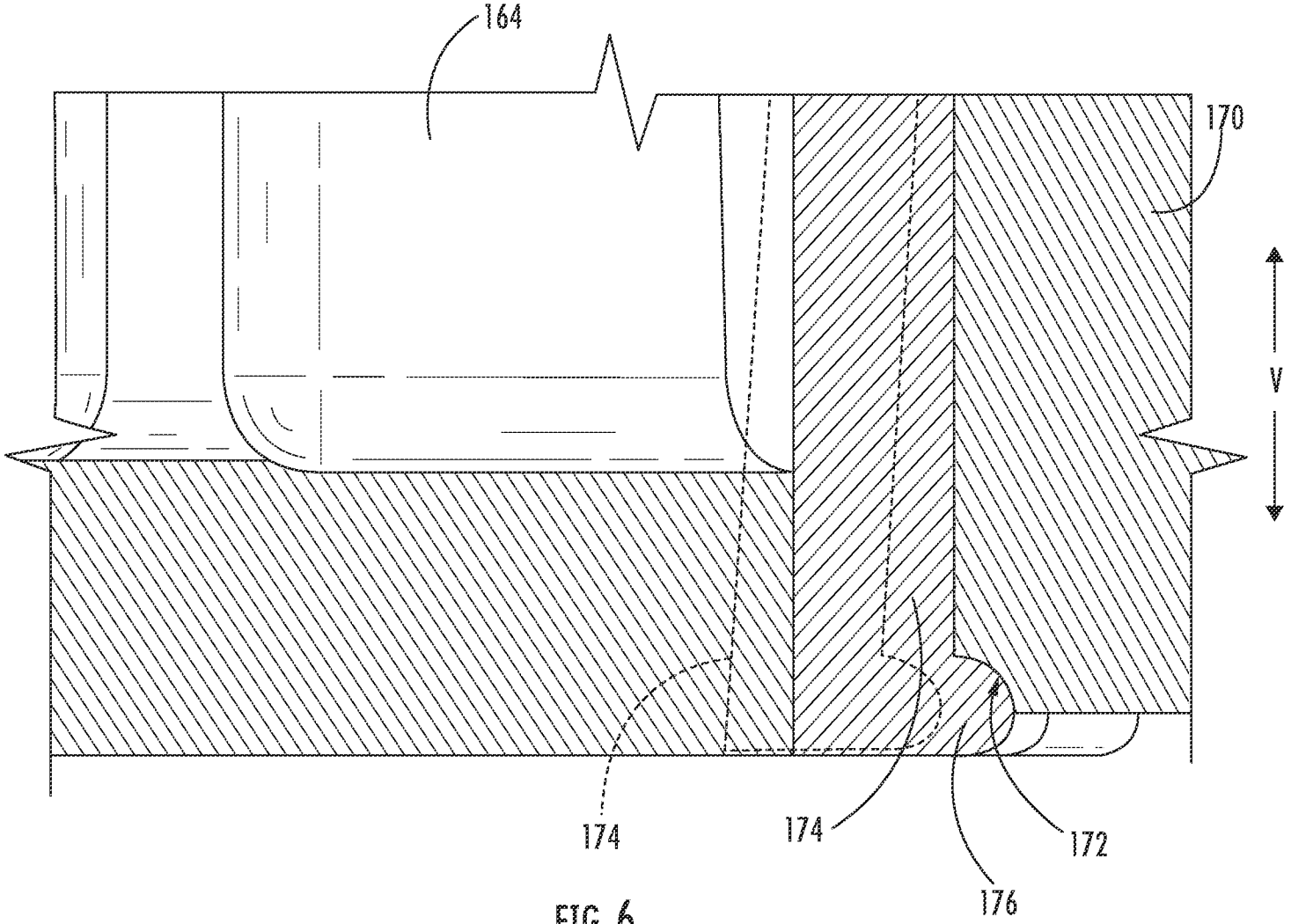
FIG. 6 provides a magnified sectional perspective view of a bottom portion of the exemplary agitation element of FIG. 3 to illustrate movement of a mating collar between the locked and unlocked positions.
Figure 7:
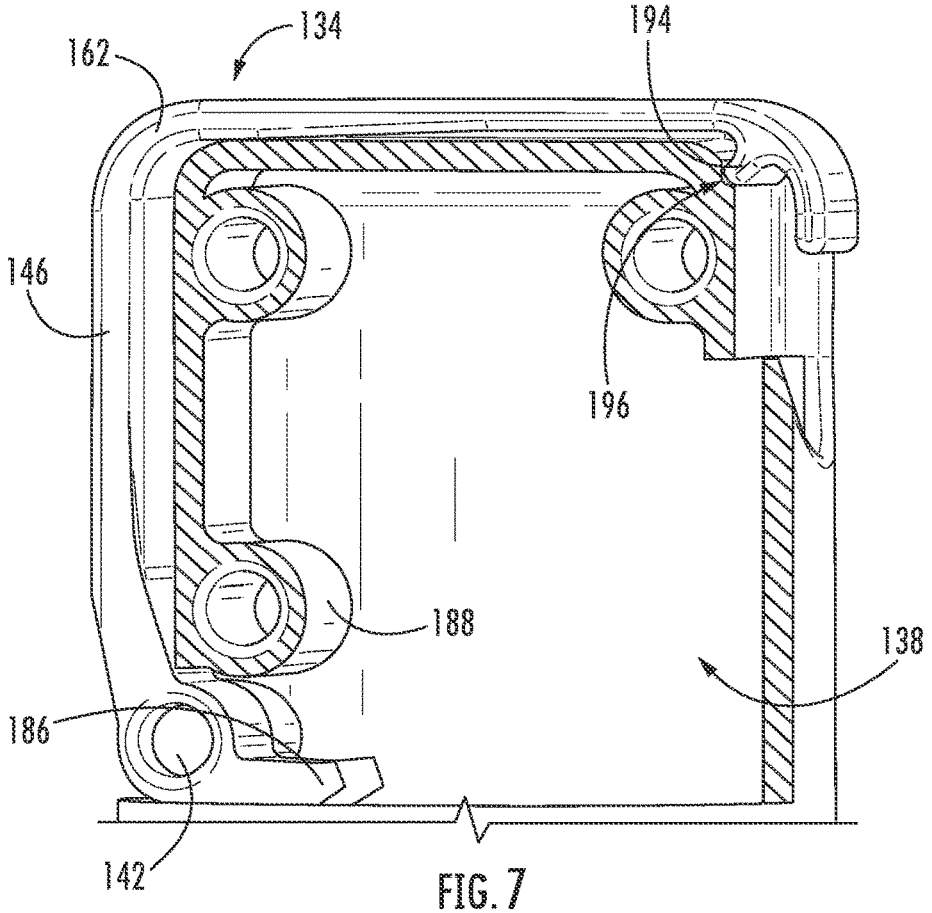
FIG. 7 provides a magnified sectional perspective view of a top portion of the exemplary agitation element of FIG. 3 in the locked position.
Figure 8:
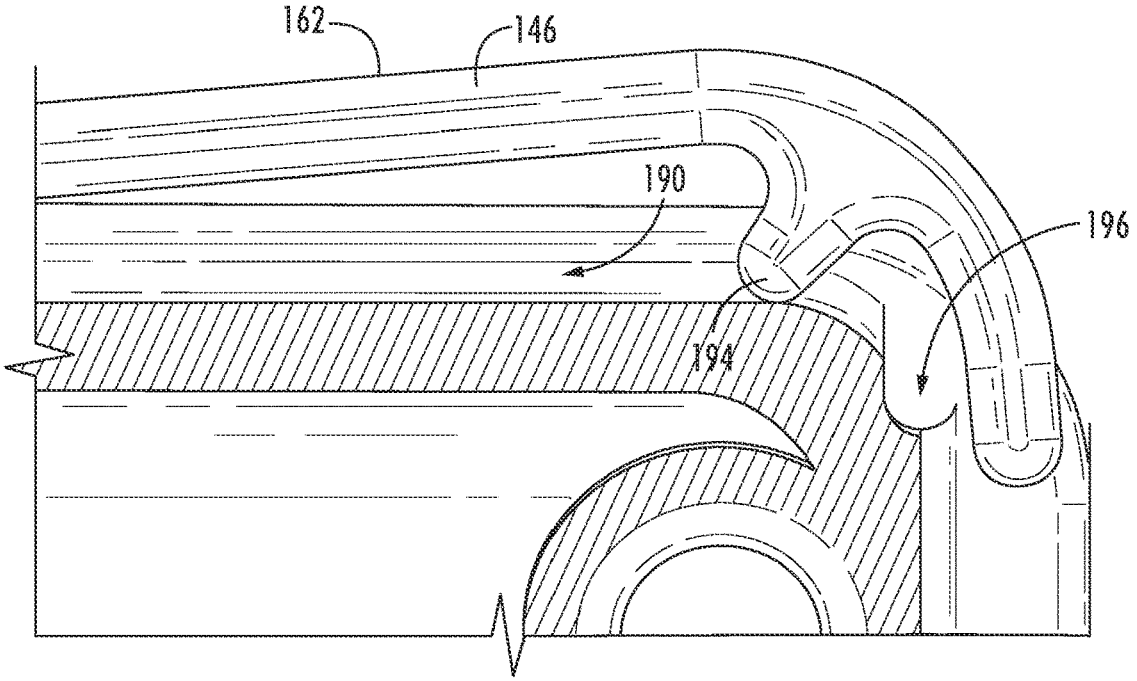
FIG. 8 provides a magnified sectional perspective view of a top portion of the exemplary agitation element of FIG. 3 moving to the locked position.
Figure 9:
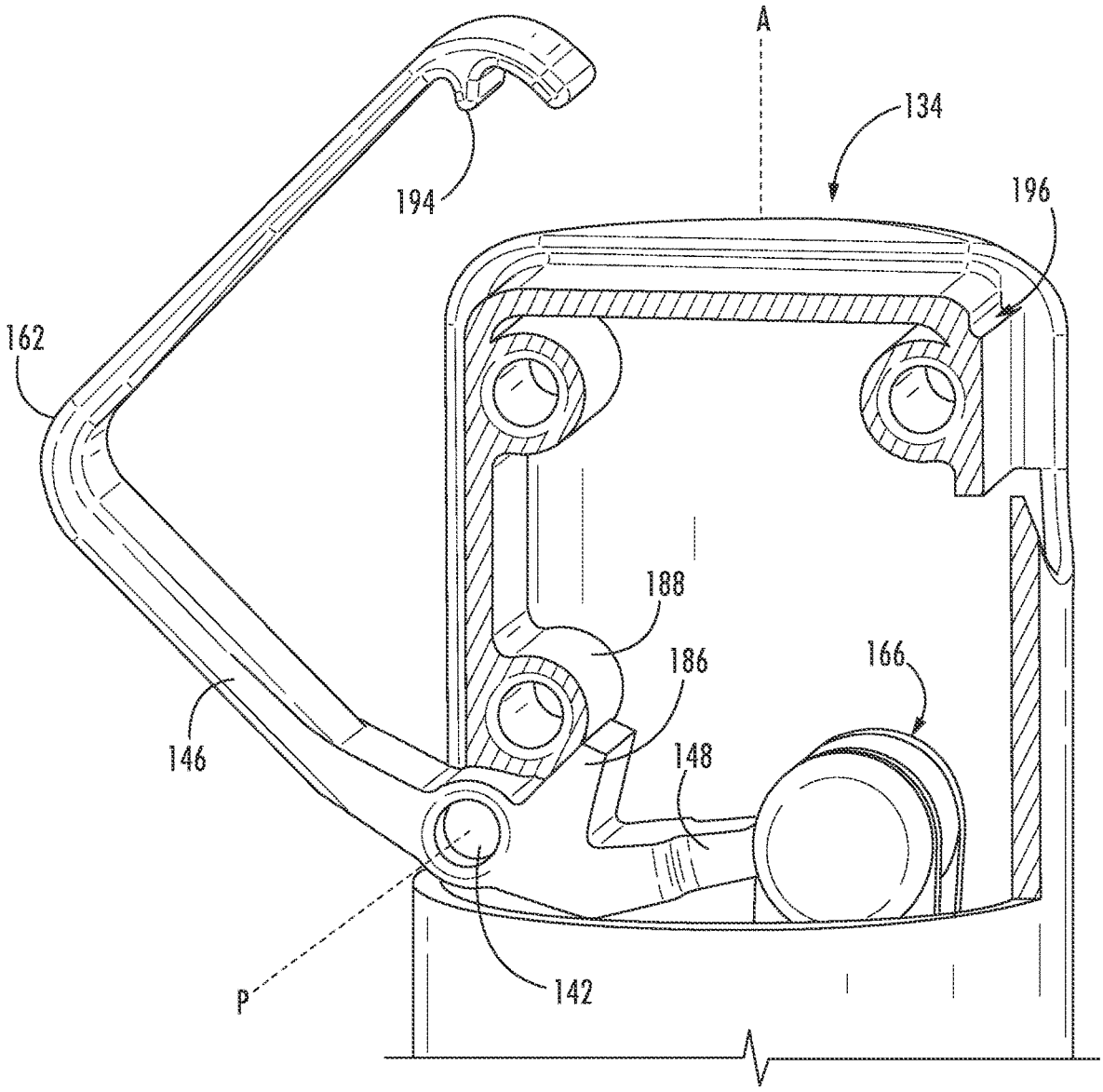
FIG. 9 provides a magnified sectional perspective view of a top portion of the exemplary agitation element of FIG. 3 in the unlocked position.
Figure 13:
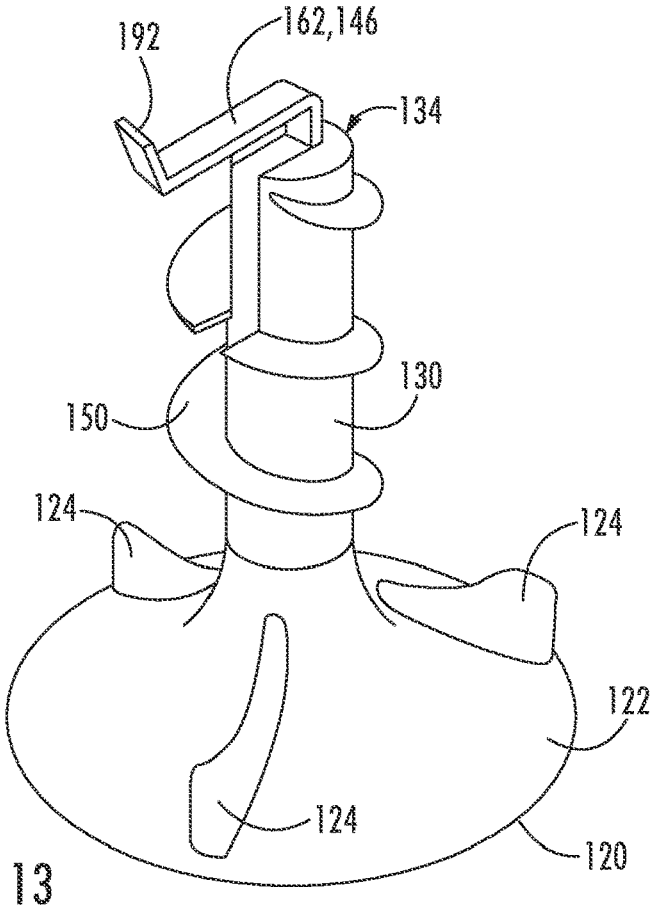
FIG. 13 provides a perspective view of the exemplary agitation element of FIG. 12 in the unlocked position.

During use, bar latch 162 may be pivoted about the pivot axis P between the locked position (e.g., FIGS. 2 through 4, 7, 10, and 12) and the unlocked position (e.g., FIGS. 5, 9, and 13). In certain embodiments, a first lever arm 146 (e.g., bent lever arm) of bar latch 162 extends in one direction from the fulcrum pin 142 (e.g.,) while a second lever arm 148 (e.g., internal lever arm) of bar latch 162 extends in another or opposite direction from the fulcrum pin 142. The first lever arm 146 may extend to a region outside of interior chamber 138 for a user to hold or engage (e.g., in order to lock or unlock extended post 130). In additional or alternative embodiments, second lever arm 148 extends into or through interior chamber 138 to contact or connect to connector bar 164. Specifically, the second lever arm 148 may connect to the upper end 166 of connector bar 164. Thus, the upper end 166 of the connector bar 164 may be attached to the bar latch 162 to move therewith. Optionally, a pivotal connection may be formed between second lever arm 148 and connector bar 164, as shown. Additionally or alternatively, a stop tab 186 be provided on bar latch 162 on the second lever arm 148 (e.g., between the fulcrum pin 142 and the connector bar 164) to selectively engage a static tab 188 formed on base body 132 within interior chamber 138 (e.g., above fulcrum pin 142) to define a stopping point for rotation of bar latch 162 to the unlocked position.

As shown, the first lever arm 146 may be formed as a bent lever arm to rest over a portion of the extended post 130 (e.g., in the locked position). Specifically, in the locked position, the first lever arm 146 may extend up and across a top surface of extended post 130. Thus, the first lever arm 146 may be selectively disposed over the top end 134 of extended post 130. In some embodiments, extended post 130 defines a trough groove 190 within which the first lever arm 146 is received. Generally, the trough groove 190 may define a recess that is complementary or similar in shape and depth to the first lever arm 146. In the locked position, the first lever arm 146 may be substantially flush with extended post 130, thereby preventing first lever arm 146 from inadvertently snagging or catching articles within wash chamber 73. In optional embodiments, such as those illustrated in FIGS. 12 and 13, first lever arm 146 may include a grip portion 192 that is matched to an auger fin 150 to form a portion of the fin body (e.g., in the locked position).

Turning especially to FIGS. 7 through 11, a snap finger 194 may be formed on a distal end of the first lever arm 146 (e.g., apart from the fulcrum pin 142). Generally, snap finger 194 may provide a resilient or elastic member to selectively hold the first lever arm 146 (and bar latch 162 generally) in the locked position. Specifically, snap finger 194 may hold first lever arm 146 in a friction fit engagement against base body 132 or post cap 180. As shown, a notch 196 may be defined to receive snap finger 194. Snap finger 194 may be formed as a resilient or elastic member capable of resilient deformation, such as to slide along a corner of base body 132 while deforming, before returning to an original shape after passing over the corner of base body 132 to sit within the notch 196.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a tub;

a basket rotatably positioned within the tub;

an impeller base rotatably mounted within the basket and defining a rotation axis, the impeller base comprising an impeller platform extending radially outward from the rotation axis, and a mounting face defined on the impeller platform coaxial to the rotation axis, the mounting face defining a recessed cup defining a lower lip extending circumferentially about the rotation axis; and an extended post removably attached to the impeller base to rotate therewith, the extended post extending along the rotation axis between a bottom end proximal to the impeller base and a top end distal to the impeller base, the extended post defining an interior cavity from the bottom end to the top end, the extended post comprising a mating collar having a mating face disposed on the bottom end in selective engagement with the mounting face at the recessed cup, the mating collar comprising a resilient finger and an enlarged radial rim extending radially outward from the resilient finger, and a connector bar comprising an attachment piston movably received within the interior cavity radially inward from the mating collar, the attachment piston being in selective engagement with the mating collar to radially motivate the mating face toward the mounting face within the recessed cup, wherein the enlarged radial rim is selectively disposed below the lower lip.

2. The washing machine appliance of claim 1, further comprising an auger fin extending radially from the extended post between the bottom end and the top end.

3. The washing machine appliance of claim 1, further comprising a post cap selectively covering the interior cavity of the extended post at the top end.

4. The washing machine appliance of claim 1, wherein the impeller base further comprises one or more impeller fins extending on the impeller platform radially outward from the recessed cup.

5. The washing machine appliance of claim 1, wherein the mating collar comprises a plurality of circumferentially spaced, resilient fingers.

6. The washing machine appliance of claim 1, wherein the extended post further comprises a base body extended from the bottom end to the top end, wherein the connector bar extends between and upper end and a lower end and is held within the base body.

7. The washing machine appliance of claim 6, wherein the connector bar is movably attached to the base body above the lower end.

8. The washing machine appliance of claim 6, wherein the lower end of the connector bar is held at or above the bottom end of the extended post.

9. An agitation element for a washing machine appliance, the agitation element comprising:

an impeller base rotatably defining a rotation axis about which the impeller base may rotate, the impeller base comprising an impeller platform extending radially outward from the rotation axis, and a mounting face defined on the impeller platform coaxial to the rotation axis, the mounting face defining a recessed cup defining a lower lip extending circumferentially about the rotation axis; and an extended post removably attached to the impeller base to rotate therewith, the extended post extending along the rotation axis between a bottom end proximal to the impeller base and a top end distal to the impeller base, the extended post defining an interior cavity from the bottom end to the top end, the extended post comprising a mating collar having a mating face disposed on the bottom end in selective engagement with the mounting face at the recessed cup, the mating collar comprising a resilient finger and an enlarged radial rim extending radially outward from the resilient finger, and a connector bar comprising an attachment piston slidably received within the interior cavity radially inward from the mating collar to move between a locked position and an unlocked position, the attachment piston being in selective engagement with an inner surface of the resilient finger at the locked position to radially motivate the mating face toward the mounting face within the recessed cup, wherein the enlarged radial rim is selectively disposed below the lower lip.

10. The agitation element of claim 9, further comprising an auger fin extending radially from the extended post between the bottom end and the top end.

11. The agitation element of claim 9, further comprising a post cap selectively covering the interior cavity of the extended post at the top end.

12. The agitation element of claim 9, wherein the impeller base further comprises one or more impeller fins extending on the impeller platform radially outward from the recessed cup.

13. The agitation element of claim 9, wherein the mating collar comprises a plurality of circumferentially spaced, resilient fingers.

14. The agitation element of claim 9, wherein the extended post further comprises a base body extended from the bottom end to the top end, wherein the connector bar extends between and upper end and a lower end and is held within the base body.

15. The agitation element of claim 14, wherein the connector bar is movably attached to the base body above the lower end.

16. The agitation element of claim 14, wherein the lower end of the connector bar is held at or above the bottom end of the extended post.

17. An agitation element for a washing machine appliance, the agitation element comprising:

an impeller base rotatably defining a rotation axis about which the impeller base may rotate, the impeller base comprising an impeller platform extending radially outward from the rotation axis, and a mounting face defined on the impeller platform coaxial to the rotation axis, the mounting face defining a recessed cup defining a lower lip extending circumferentially about the rotation axis; and an extended post removably attached to the impeller base to rotate therewith, the extended post extending along the rotation axis between a bottom end proximal to the impeller base and a top end distal to the impeller base, the extended post defining an interior cavity from the bottom end to the top end, the extended post comprising a mating collar having a mating face disposed on the bottom end in selective engagement with the mounting face at the recessed cup, the mating collar comprising a plurality of resilient fingers and an enlarged radial rim extending radially outward from the plurality of resilient fingers, and a connector bar comprising an attachment piston slidably received within the interior cavity radially inward from the mating collar to move between a locked position and an unlocked position, the attachment piston being in selective engagement with an inner surface of the plurality of resilient fingers at the locked position to radially motivate the mating face toward the mounting face within the recessed cup, wherein the enlarged radial rim is selectively disposed below the lower lip, wherein the extended post further comprises a base body extended from the bottom end to the top end, wherein the connector bar extends between and upper end and a lower end and is held within the base body, and wherein the connector bar is movably attached to the base body above the lower end.

18. The agitation element of claim 17, wherein the lower end of the connector bar is held at or above the bottom end of the extended post.

* * * * *